United States Patent [19]

Castleberry

[11] 3,938,666

[45] Feb. 17, 1976

[54] RACK ASSEMBLY

[76] Inventor: William R. Castleberry, 409 Franklin, San Marcos, Tex. 78666

[22] Filed: Oct. 21, 1974

[21] Appl. No.: 516,651

[52] U.S. Cl. ..... 211/49 D; 211/113; 211/184

[51] Int. Cl.[2] ..... A47F 5/10

[58] Field of Search..... 211/49 D, 49 R, 184, 175, 211/113; 312/42, 45; 221/92

[56] References Cited

UNITED STATES PATENTS

| | | | |
|---|---|---|---|
| 1,524,748 | 2/1925 | O'Connor | 211/49 D |
| 1,562,381 | 11/1925 | Stoyka | 211/113 |
| 1,782,597 | 11/1930 | Blackman | 312/42 X |
| 2,728,623 | 12/1955 | Foerstner | 211/49 R X |
| 2,901,118 | 8/1959 | Beesley | 211/49 D |
| 3,018,001 | 1/1962 | Combs | 211/49 D |
| 3,152,697 | 10/1964 | Berman et al. | 211/49 D |
| 3,393,808 | 7/1968 | Chirchill | 211/49 D |
| 3,744,866 | 7/1973 | Cook | 211/49 D X |

FOREIGN PATENTS OR APPLICATIONS

| | | | |
|---|---|---|---|
| 1,340,938 | 9/1963 | France | 211/49 D |

*Primary Examiner*—Ramon S. Britts

*Attorney, Agent, or Firm*—Cox, Smith, Smith, Hale & Guenther Incorporated

[57] ABSTRACT

A vertical storage, display and dispensing rack assembly is shown which is filled from the front and dispenses articles from the front. The rack has a plurality of slots with each slot being adjustable in both width and depth so that a different sized article may be dispensed from each slot. Retaining flanges hold the articles in the individual slots with the lower front being open for ease of dispensing the articles. The rack assembly has interchangeable components for ease of assembly or change of configuration to accommodate different size articles in accord with the changing needs.

13 Claims, 15 Drawing Figures

RACK ASSEMBLY

BACKGROUND OF THE INVENTION

This invention relates to a storage display and dispensing rack assembly and, more particularly, to a rack assembly that may be utilized by a business establishment such as a retail food outlet that specializes in a large volume of business. Prior to the present invention many different types of dispensing apparatus have been manufactured and sold to the public. A typical such apparatus is shown in Chirchill (U.S. Pat. No. 3,393,808) wherein canned articles are dispensed by horizontally sloping shelves with the articles being inserted in the apparatus from the top rear. chirchill has the specific limitation of requiring a large amount of counter space which is at a premium in most retail food outlets. Also, Chirchill is not totally adjustable so that articles of varying diameter and length can be dispensed from the apparatus and still minimize the space required.

Many different types of vending machines have been patented in the last 50 years with specific patents drawn to the dispensing apparatus of the vending machines. However, none of the vending machines have the total adjustability to accommodate articles of varying width and depth and still utilize the smallest space possible. The few vending machines that are adjustable either require all the articles to be of one size or require that certain components within the vending machine be replaced with other components of a varying size. The vending machine apparatus as described in the prior art is totally unacceptable for a business establishment such as a retail food outlet wherein the counter space is at a premium.

Several different types of wall mounted display and storage racks have been patented in the past with Combs (U.S. Pat. No. 3,018,001) being a typical example. In Combs the rack is attached to the wall or backing member. In most business establishments that are of dry wall construction it would require considerable modification to the wall structure to prevent damage. Though Combs is adjustable in width the depth of the individual stacks can only be changed by replacing the divider panels. Such a device as shown in Combs would not have the complete versatility as the rack assembly shown and claimed in the present invention, and would not be suitable for the typical retail food outlet.

SUMMARY OF THE INVENTION

It is an object of the present invention to provide a storage, display and dispensing rack assembly for retaining articles of varying sizes.

It is a further object of the present invention to provide a rack assembly for dispensing articles with the rack assembly occupying the minimum amount of counter space.

It is yet another object of the present invention to provide a vertical storage, display and dispensing rack assembly that may be adjusted in width and depth to accommodate articles of varying sizes.

It is yet another object of the present invention to provide a storage, display and dispensing rack assembly that is entirely prefabricated so that it can be quickly assembled for use without the use of tools.

It is even a further object of the present invention to provide a rack assembly for dispensing light articles that can be suspended from the ceiling, the rack assembly having adjustment for the width and the depth of the articles being dispensed.

It is another object of the present invention to provide a storage, display and dispensing rack assembly that uses a mininum amount of counter space, that can be filled from the front, and that dispenses articles from the front.

It is even another object of the present invention to provide a rack assembly that may be used in the kitchen area of a retail food outlet to provide all articles necessary in the preparation of foods while requiring a mininum amount of storage space.

It is another object of the present invention to provide a rack assembly that is entirely prefabricated by such substances as molded plastic so that the rack assembly is very light in weight, structurally sound, inexpensive to manufacture and pleasing to the eye.

The rack assembly of the present invention is formed from a minimum number of standard interchangeable components to provide for the storage, display and dispensing of articles of varying sizes. The internal vertical walls may be adjusted for articles of varying width, with peg members providing for adjustment of varying depth to insure that each and every article dispensed is immediately at the fingertips of the person needing the article. The rack assembly may be quickly assembled according to the needs of the individual by putting locking tabs through preformed holes made in the structural elements.

BRIEF DESCRIPTION OF THE PREFERRED EMBODIMENT

Figure 2:
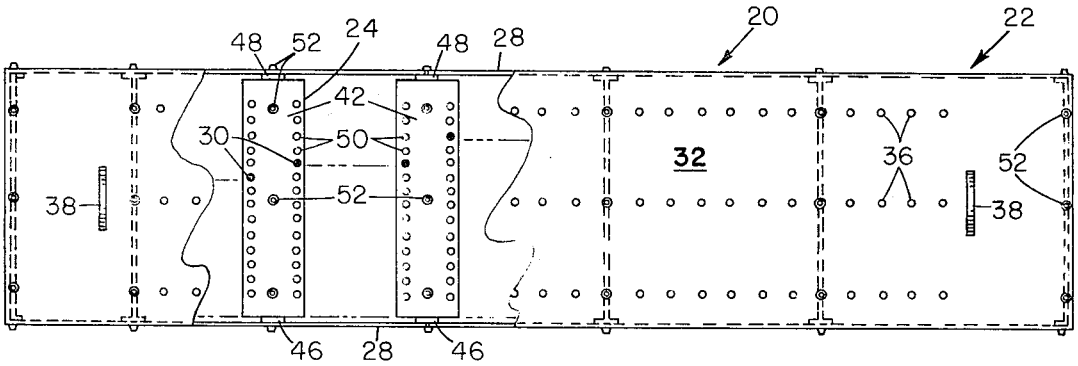
FIG. 2 is a top view of the rack assembly shown in FIG. 1.

Referring now to FIGS. 1, 2, 3 and 4 in combination there is shown a rack assembly represented generally by the reference numeral 20. The rack assembly 20 has several basic components which are identical for ease of manufacturing and assembly. The rack assembly 20, which is very lightweight in construction, consists of a top 22, internal vertical walls 24, side walls 26 and cross braces 28. An optional feature of the rack assembly 20 utilizes depth adjustment rods 30.

Referring now to the individual component parts, the top 20 has an upper surface 32 with a reinforcing downward flange 34 surrounding the upper surface. In the upper surface there is formed a series of equally spaced holes 36 running lengthwise thereof. The function of the holes 36 will be explained in more detail subsequently. Several rows of holes may be utilized with the present invention; however, for the purposes of the preferred embodiment, three rows of equally spaced holes are used. Also formed with or attached to the upper surface 32 are mounting flanges 38 whereby the entire rack assembly 20 may be attached to an overhead structure such as the ceiling.

Figure 5:
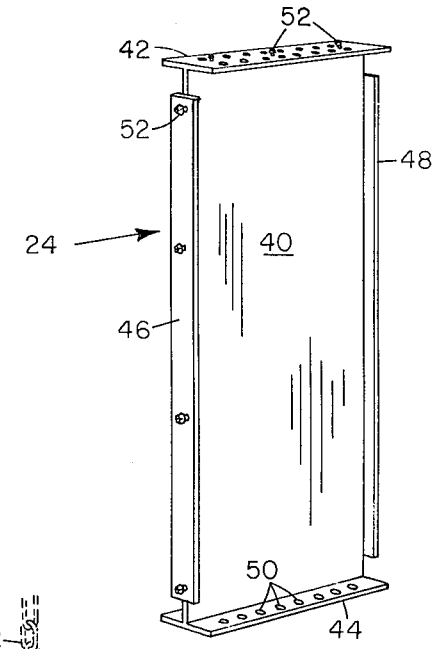
FIG. 5 is a perspective view of an internal vertical wall used between the individual compartments of the rack assembly shown in FIGS. 1–4.
Figure 15:
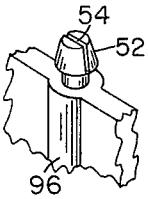
FIG. 15 is a perspective view of the locking tab used in the prior views.

The internal vertical walls 24 which can be seen in more detail in FIG. 5 consists of a wall portion 40, an upper flange 42, bottom flange 44, front flange 46 and rear flange 48. The upper flange 42 and bottom flange 44 have a series of equally spaced holes 50 contained in both sides of both flanges 42 and 44. Around the outer portion of internal vertical wall 24 are located blocking tabs 52 with an example of a locking tab being shown in more detail in FIG. 15. The locking tab 52 has a slot 54 cut therein so that the locking tabs can securely mate with the holes 36 and subsequently described holes 56. From the perspective view shown in FIG. 5 and FIGS. 1–4 it becomes obvious that the internal vertical wall 24 is completely reversible with the front being identical to the back and the top being identical to the bottom.

The side wall 26 can be the same as the internal vertical walls 24; however, in the preferred embodiment the portion of the upper flange 42, bottom flange 44, front flange 46 and rear flange 48 that extends beyond end wall 58 has been cut off. Again the side wall 26, the same as internal vertical wall 24, is completely reversible with the only requirement being that the flanges turn inward which gives a square corner for the rack assembly 20.

Figure 1:
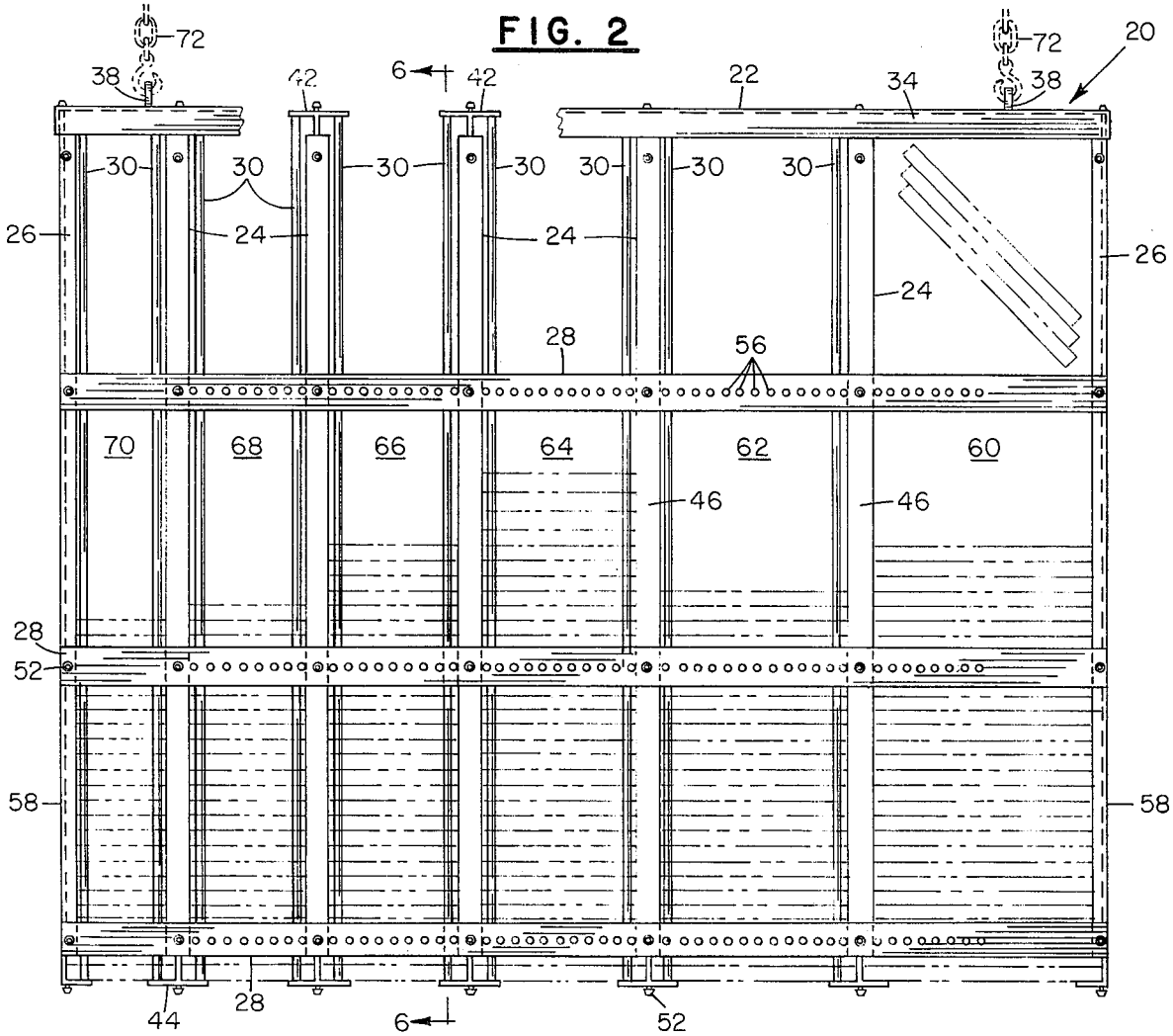
FIG. 1 is a front view of a box rack assembly embodying the present invention with a portion of the top cut away for illustration purposes.
Figure 4:
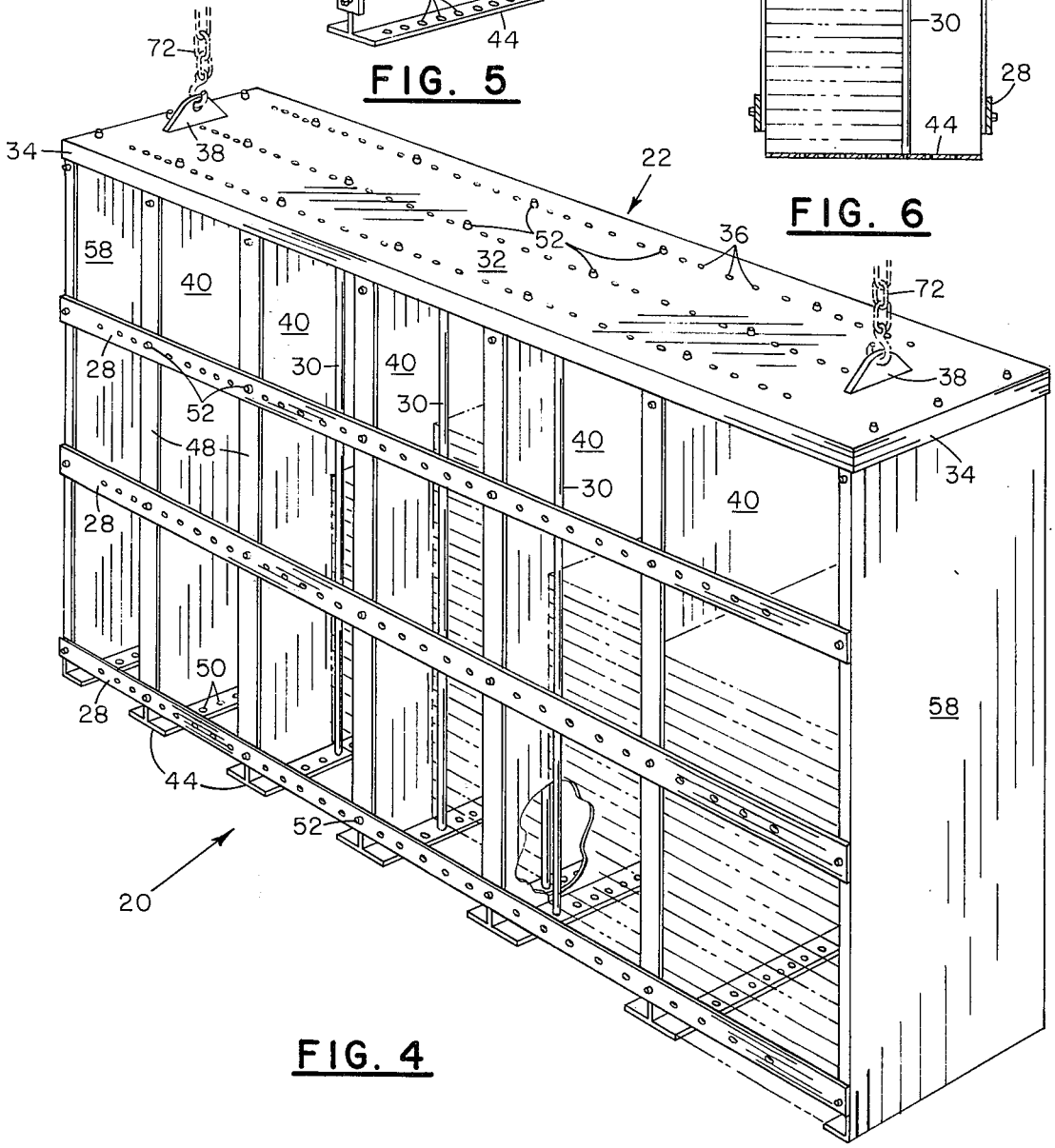
FIG. 4 is a rear perspective view of the rack assembly shown in FIG. 1.

Because the rack assembly 20 is completely adjustable in width and depth a determination should be made concerning what articles will be stored in the rack assembly 20 before beginning the assembly of the component parts. Since rack assembly 20 is designed primarily for very light boxed articles, the length and depth of the box are the controlling factors in determining the width and depth of each individual compartment in the rack assembly 20. Assume, for the purposes of illustration, that a person desires to use the rack assembly 20 in a business establishment that specializes in the sale of pizzas. Since this particular business establishment has a total of six different size pizzas, each compartment must be adjusted to accommodate each size pizza box. Compartment 60 (see FIG. 1) is adjusted to accommodate the largest size pizza box which fills the entire compartment as shown in FIGS. 1 and 4. Each of the other compartments 62, 64, 66, 68 and 70 are adjusted accordingly, according to the size of pizza box being contained therein.

In constructing the rack assembly 20 a side wall 26 is connected to one end of top 22 by insertion of the locking tabs 52 through holes (obstructed from vision in the drawings) in the top 22. Next, an internal vertical wall 24 is secured to top 22 again by insertion of the locking tabs 52 into holes 36 allowing just enough distance for the pizza boxes to set flat in the compartment 60 and rest on bottom flange 44. Each of the following compartments 62, 64, 66, 68 and 70 is constructed in a similar manner with only enough width being allowed between internal vertical walls 24 so that the appropriately sized pizza box would rest on the bottom flange 44. The last compartment 70 is formed by the insertion of locking tabs 52 of the opposing side wall 26 into holes contained in top 22. Thereafter a series of cross braces 28 are attached across the front and back of rack assembly 20 by insertion of locking tabs 52 through holes 56 of the cross braces. The holes 56 of the cross braces 28 are uniformly spaced the same as holes 36 of top 22. At this point the rack assembly 20 is completely reversible with either side being the front or back with appropriate adjustments having been made for the varying widths of the boxes contained therein. The boxes could be inserted from either the front or the back by holding the box in a diagonal position and inserting into the compartment as illustrated in FIG. 1 compartment 60. The rack assembly 20 could be either hung from the ceiling by any suitable means such as chains 72 or placed on the supporting counter for the convenience of the user.

Figure 3:
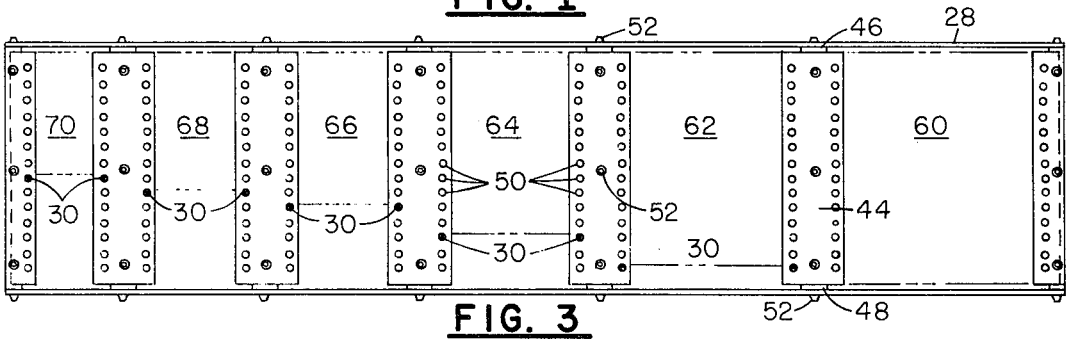
FIG. 3 is a bottom view of the rack assembly shown in FIG. 1.

To provide a depth adjustment to the individual compartments to accommodate boxes of shorter length, a depth adjustment rod 30 may be inserted in holes 50 of upper flange 42 and bottom flange 44 of the appropriate internal vertical wall 24 and/or side walls 26. The depth adjustment rod 30 may be constructed and inserted in a number of different ways; however, in the preferred embodiment of this invention the depth adjustment rod 30 should have a very short small diameter portion on each end for insertion in the respective hole 50. Because the depth adjustment rod 30 is of considerable length it may be flexed outward thereby putting each end in the appropriate hole 50. A shoulder rests against the bottom flange 44 to prevent the depth adjustment rod 30 from falling out of the bottom of the rack assembly 20. Of course, it is possible that the depth adjustment rods 30 be inserted in the internal vertical walls 24 and/or side walls 26 prior to assembly with the top 22 and cross braces 28. FIGS. 3 and 4 illustrate the varying depth as maintained in the compartments 60, 62, 64, 66, 68 and 70.

Figure 6:
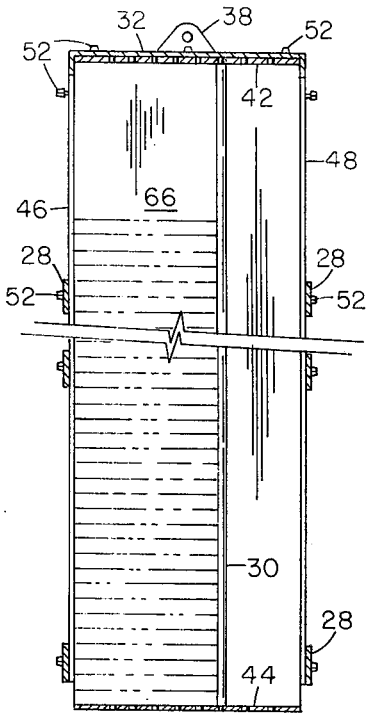
FIG. 6 is a sectional view of FIG. 1 along section lines 6—6.

If the boxes contained in the respective compartment are of a height substantially different from the height of the boxes shown in FIGS. 1, 4 and 6, a change may have to be made to the internal vertical walls 24 and/or side walls 26. The lower front cross brace 28 will have to be removed or moved upward. If the front flange 46 still interferes with the dispensing of the boxes because of the increased height of the boxes, the flange 46 will have to be altered. The flange 46 can be cut to allow for the increased height of the boxes, or the walls 24 and/or 26 could be manufactured with the flange allowing increased space for dispensing boxes of increased height. Also, the flange 46 could have a sliding adjustment on the lower portion to accommodate boxes of different heights, but this would add to the cost of the component part.

FIG. 6 is a cross sectional view along section lines 6—6 of FIG. 1, wherein the depth adjustment of compartment 66 is better illustrated. The small diameter portion on each end of the depth adjustment rod can be seen with more clarity in FIG. 6. If the depth adjustment rods 30 are rigid, then the small diameter portion of the upper part could be increased in length, thereby allowing the upper portion of the depth adjustment rod to be inserted first and thereafter the lower portion to be inserted prior to assembly with the top 22.

ALTERNATIVE EMBODIMENT

Referring now to FIGS. 7–14, there is shown another rack assembly represented generally by the reference numeral 72 that is designed primarily for heavy objects such as cylinder cans of varying sizes. The rack assembly 72 must set on a solid foundation such as a counter top because of the weight of the articles contained therein. The rack assembly 72 consists of basically the same parts as the prior mentioned rack assembly 20 and has a top 74, adjustable internal vertical walls 76 and a base frame 78. The base frame 78 though it may be constructed in numerous ways is shown in this alternative embodiment as being a single unitary mold with a back 80, bottom 82 and sides 84.

Figure 14:
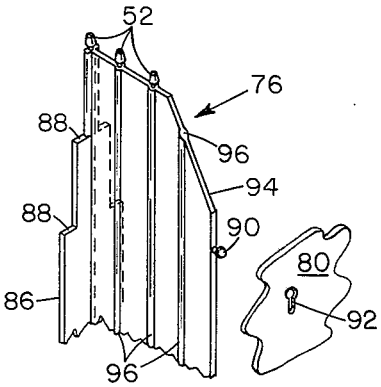
FIG. 14 is an exploded sectional view of FIG. 7 illustrating the connection between the back and the internal vertical wall.

Referring now to the individual components, the internal vertical walls 76 are very similar to the internal vertical walls 24 of the previously mentioned rack assembly 20. A front flange 86 is formed integral with the front of internal vertical walls 76. The front flange 86 has a step 88 cut in both the bottom and the top thereof with the function of the step 88 being subsequently described. Referring to FIG. 14, there is shown an upper sectional view of the internal vertical wall 76. Locking tabs 52 are formed integral with the top and bottom of internal vertical wall 76. Also, the rear of internal vertical wall 76 has a rear tab 90 formed integral therewith that mates in key slot 92 of back 80. The rear upper and lower corner of internal vertical wall 76 has a diagonal cut 94. Reinforcing ribs 96 extend lengthwise of the internal vertical wall 76 to insure a maximum strength when the rack assembly 72 is filled with heavy articles. It should be understood that the top and the bottom of internal vertical wall 76 is identical and reversible for ease of installation.

Figure 10:
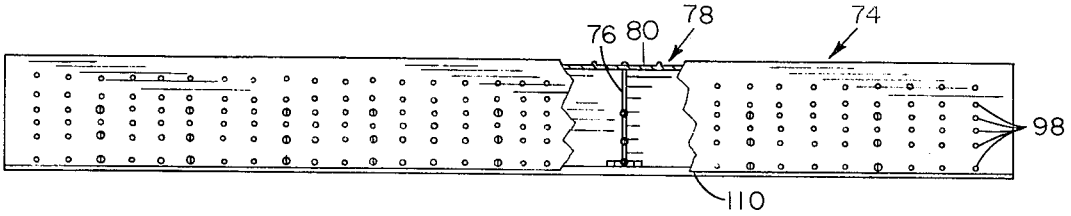
FIG. 10 is a top view of the rack assembly shown in FIG. 7 with a partial sectional to illustrate the construction of the internal vertical wall.
Figure 11:
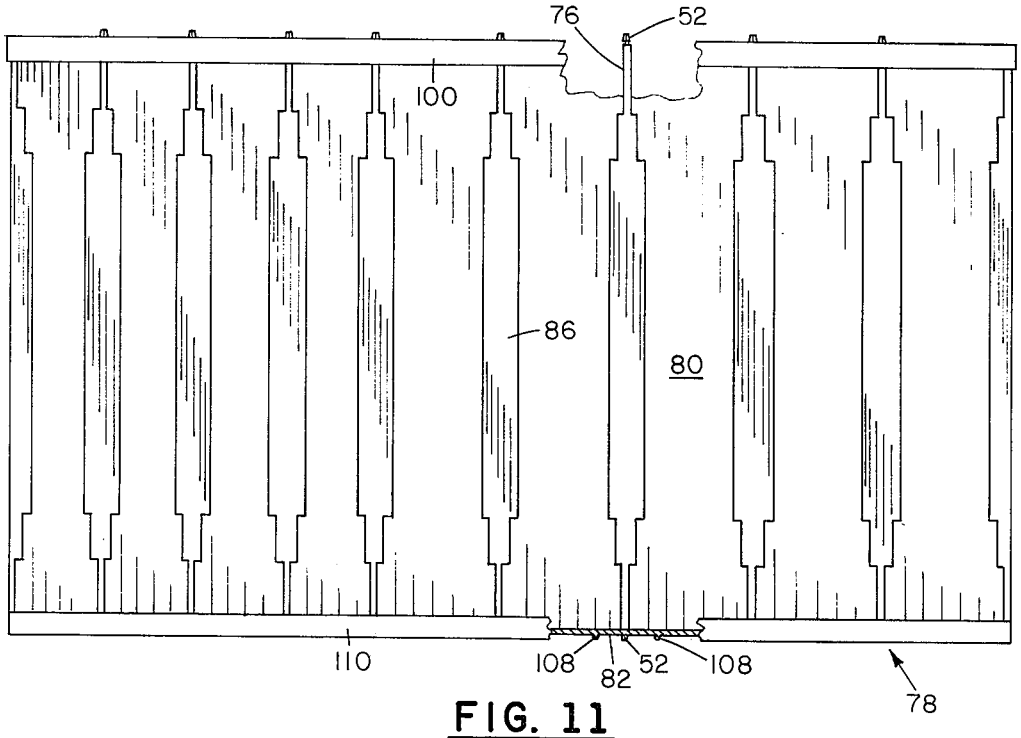
FIG. 11 is a front view of FIG. 10 with a partial sectional to illustrate the construction of the internal vertical wall.

Referring now to the top 74 as can be clearly seen in FIG. 10 there is a series of equally spaced aligned holes 98 extending thereacross. Also, around top 74 is a downward flange 100 to give extra strength and beauty to the top 74.

The base frame 78 connects with the other elements to form the rack assembly 72. The back 80 has formed therein key slots 92 (see FIG. 14) that are equally spaced longitudinally across the back to match holes 98 in top 74. Approximately three key slots will be required to retain each internal vertical wall 76. The back 80 has a series of vertically extending reinforcing ribs 102. The lower rear portion of the back 80 forms a diagonal kick plate 104, the function of which will be described in detail subsequently.

The bottom 82 of base frame 78 has an equal number of equally spaced and aligned holes 106 as does top 74. The holes 98 in top 74 align with the holes 106 in bottom 82. Bottom 82 has a series of reinforcing ribs 108 that extend up the back 80 to form reinforcing ribs 102. The front portion of the bottom 82 has a stop flange 110 that extends upward from the bottom 82 and prevents the articles contained in rack assembly 72 from spilling.

Figure 8:
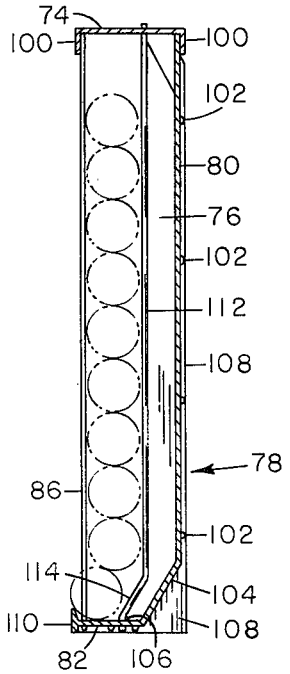
FIG. 8 is a sectional view of FIG. 7 along section lines 8—8.
Figure 7:
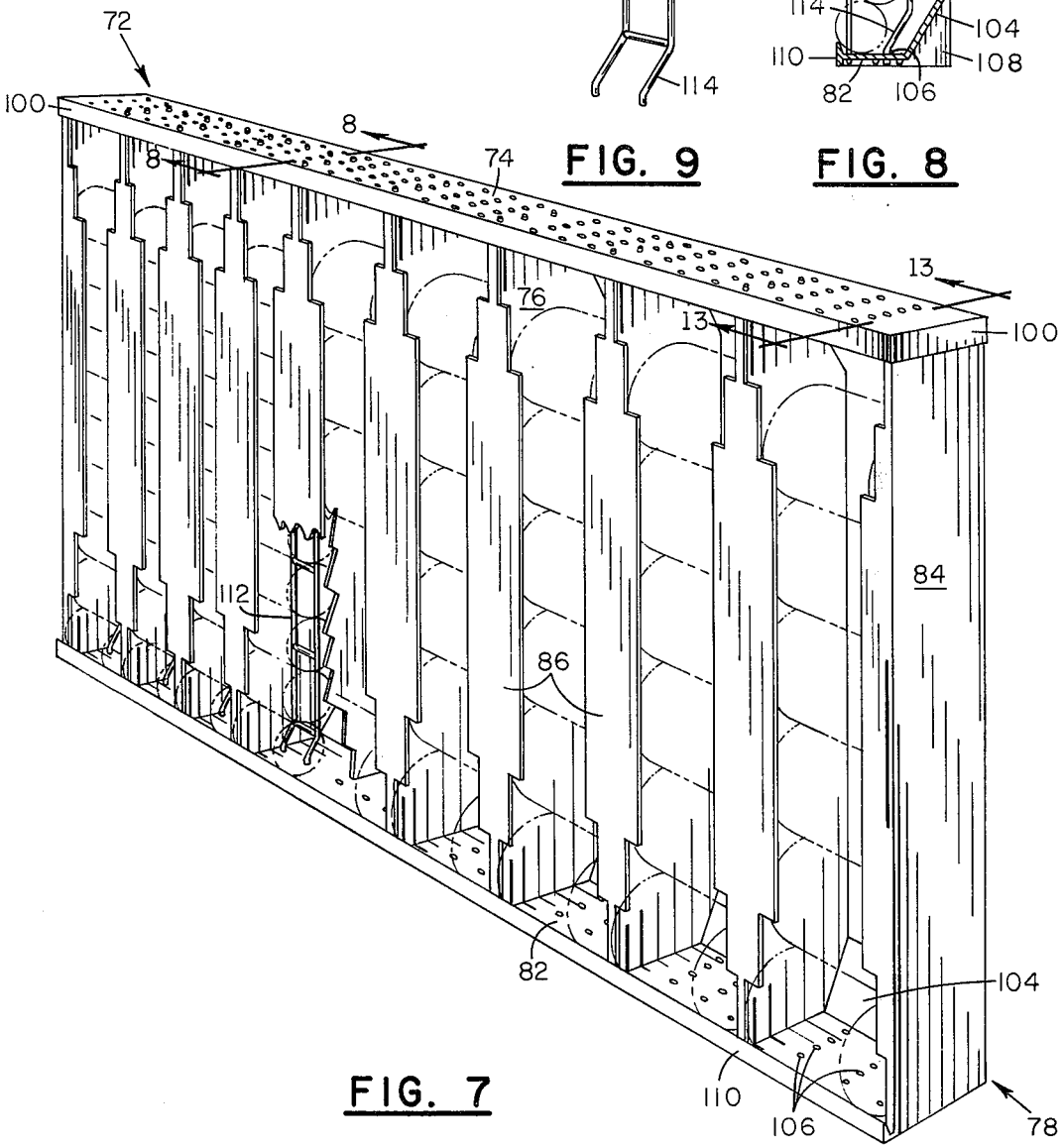
FIG. 7 is a front perspective view of a can rack assembly embodying the present invention.
Figure 13:
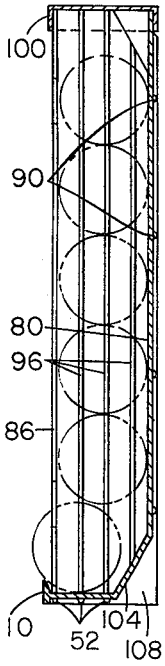
FIG. 13 is a sectional view of FIG. 7 along section lines 13—13.
Figure 12:
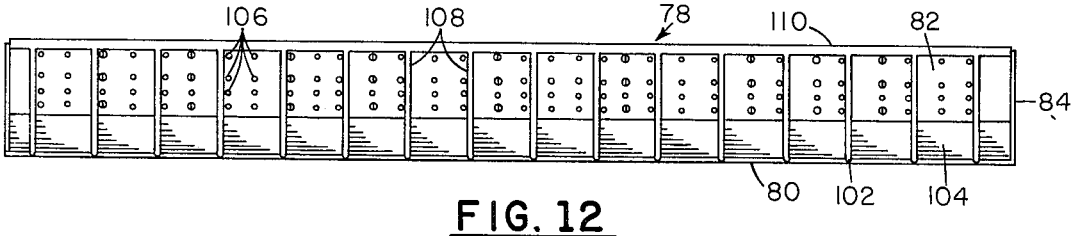
FIG. 12 is a bottom view of FIG. 11.

The sides 84 are made in a rectangular form and formed integral with the bottom 82 and back 80. The previously described flange 86 only extends inward from sides 84. FIGS. 7, 8 and 13 show how the sides 84 extend an equal distance with the reinforcing ribs 96 and 108 to provide a very neat uniform appearance.

The rack assembly 72, as described in conjunction with this embodiment, is manufactured by a molding process with the entire base frame 78 being one solid piece. Before assembling the rack assembly 72 a determination needs to be made as to what size of cylinder type articles are going to be stored in the rack assembly 72. Though the rack assembly 72 may be constructed in any size, the sizes shown in FIGS. 7–14 will accommodate cans of all sizes up to and including a gallon size can, commonly called a No. 10 can. Once a determination has been made as to what size cylindrical articles will be stored in rack assembly 72, the internal vertical walls 76 should be connected to the base frame 78 by inserting the rear tab 90 into key slots 92 and pushing downward so that the rear tabs 90 and key slots 92 will lock and the locking tabs 52 will lock into holes 106 of bottom 82. After all of the internal vertical walls 76 are securely fastened into place allowing only enough distance between the internal vertical wall 76 and sides 84 to accommodate the length of the cylindrical articles, the top 74 may be securely fastened by inserting the locking tabs 52 into the holes 98 to complete the construction of the rack assembly 72. In using the rack assembly 72 it is contemplated that it will set on the rear portion of a counter at the fingertips of the person needing articles from the rack assembly 72.

Figure 9:
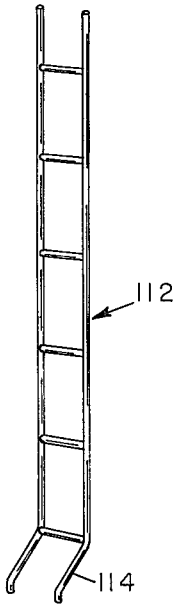
FIG. 9 is a perspective view of the depth adjuster shown in FIGS. 7 and 8.

As an optional feature of the rack assembly 72, there is a depth adjustment spacer 112 as shown in FIG. 9 that can be used to adjust the depth of the individual compartment. The depth adjustment spacer 112 is inserted in the holes 106 of the bottom 82 and the holes 98 of top 74. As can be seen in the sectional view of FIG. 8, the depth adjustment spacer which is designed for use with smaller cans also has a diagonal portion 114 to insure even the smaller cans are kicked out towards stop flange 110. This can be very easily seen in the sectionalized portion of FIG. 7 and the cross sectional view shown in FIG. 8. To insert the depth adjustment spacer 112 the top is inserted in holes 98 and allowed to drop down into holes 106, thereby retaining the spacer in a fixed position.

After assembly the cans are inserted from the upper front portion of the rack assembly 72 by inserting the cans in the horizontal position. The step portion 88 of front flange 86 allows the large No. 10 cans to be inserted from the top and to be withdrawn from the bottom as shown in FIGS. 7 and 13. However, for the smaller size cans they will be inserted above the uppermost portion of flange 86 and be retained therein until they drop below the lowermost portion of flange 86. If a uniform flange from top to bottom were utilized instead of the step flanges shown in this embodiment the smaller size can would fall out at the bottom if enough space was allowed to accommodate a No. 10 can. The depth adjustment spacer 112 insures that the smaller size cans are maintained at the front of the rack assembly 72 for ease in dispensing the cans. Again, assume that the rack assembly 72 is being used in a retail food business that specializes in pizzas. If the rack assembly 72 is placed on the rear portion of a counter, adequate counter work space will still remain in front of the rack assembly 72. The person who is making the pizzas would have all the ingredients at his fingertips with the various ingredients such as tomato paste, olives, cheese, etc. being contained in the rack assembly 72. This eliminates the storage problem and frequent trips to the storage room for additional ingredients being used in the preparation of the food. Since it is anticipated that the rack assembly 72 will contain articles having substantial weight, it should be placed on a structure that will sustain the weight of the rack assembly 72 when filled. To insure that the rack assembly 72 will not topple forward, it may be secured to the wall by any convenient means such as screws through key slots 92 in the back 80.

Though the rack assemblies 20 and 72 were described in conjunction with the retail food business that maintains a fairly high volume, it should be understood that it could be used for any other purpose wherein it is desirable to maintain objects at the fingertips of individuals such as a retail store outlet. The rack assembly 72 would be ideal for a paint counter in a hardware store, not to mention the numerous applications inside of a grocery store or service station. These and many other applications should be evident from the prior description.

I claim:

1. A rack assembly for storing and dispensing articles of varying width and depth comprising:

adjustable vertical walls forming vertical compartments therebetween;

bottom means for carrying the weight of said articles contained in said compartments, said bottom being connected to said adjustable vertical walls;

retaining means connected to said adjustable vertical wall for holding said articles in said compartments until dispensed;

top means for detachably connecting to the uppermost portion of said vertical walls;

depth adjustment means extending from said top means to said bottom means to maintain smaller articles at the front of said compartments until dispensed;

cooperating means on said top means, bottom means and said depth adjustment means to allow adjustments in depth of said vertical compartments without removing said depth adjustment means from within said rack assembly;

said articles feeding by gravity as an individual article in a compartment is removed through an opening in the bottom portion of said retaining means thereby allowing the remaining articles in that compartment to drop downward.

2. The rack assembly as recited in claim 1 wherein said retaining means includes front flanges on said adjustable vertical walls extending from near the top means to said opening in said retaining means.

3. The rack assembly as recited in claim 2 wherein said retaining means includes a back member and side members; said back member connecting to said vertical walls, said top means, said side members and said bottom means; said side members also including front flanges similar to said front flanges on said adjustable vertical walls.

4. The rack assembly as recited in claim 3 further including means for moving the lowermost of said articles forward, and a stop means attached to the front portion of said bottom means to hold the lowermost article in said rack assembly until needed.

5. The rack assembly as recited in claim 4 wherein said front flanges have a space between their uppermost portion and said top means for insertion of said articles in said compartments, a distance being allowed between said front flanges to view said article contained in said compartments.

6. The rack assembly as recited in claim 5 wherein said front flanges are stepped outward at the top and bottom thereof to insert and remove articles of varying diameters.

7. The rack assembly as recited in claim 2 wherein said adjustable vertical walls are connected by locking tabs and holes.

8. The rack assembly as recited in claim 2 wherein said retaining means includes rear flanges on said adjustable vertical walls for holding said articles in said compartment, said articles being inserted diagonally between said flanges into said compartments.

9. The rack assembly as recited in claim 8 further includes cross brace means secured to adjustable vertical walls.

10. The rack assembly as recited in claim 9 wherein said adjustable vertical walls are connected by locking tabs and holes.

11. The rack assembly as recited in claim 9 wherein said articles are dispensed through said opening between the lowermost portion of said front and rear flanges and said bottom means.

12. The rack assembly as recited in claim 11 wherein said depth adjustment means are removable rods extending from said top means to said bottom means.

13. The rack assembly as recited in claim 12 further including a means for suspension from an overhead.

* * * * *